US009580871B2

(12) United States Patent
Hermans et al.

(10) Patent No.: US 9,580,871 B2
(45) **Date of Patent: *Feb. 28, 2017**

(54) ABSORBENT TISSUE

(71) Applicant: Kimberly-Clark Worldwide, Inc., Neenah, WI (US)

(72) Inventors: Michael Alan Hermans, Neenah, WI (US); Gretchen Sarah Koch, Hortonville, WI (US); Maruizio Tirimacco, Appleton, WI (US); Erin Ann McCormick, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/241,176

(22) Filed: Aug. 19, 2016

(65) Prior Publication Data

US 2016/0355987 A1 Dec. 8, 2016

Related U.S. Application Data

(63) Continuation of application No. 14/962,676, filed on Dec. 8, 2015, now Pat. No. 9,447,545, which is a continuation of application No. 14/271,545, filed on May 7, 2014, now Pat. No. 9,234,313, which is a continuation of application No. 13/755,442, filed on Jan. 31, 2013, now Pat. No. 8,753,751.

(51) Int. Cl.
*D21H 27/00* (2006.01)
*D21H 11/04* (2006.01)
*D21H 21/20* (2006.01)

(52) U.S. Cl.
CPC ..... *D21H 27/007* (2013.01); *D21H 11/04* (2013.01); *D21H 21/20* (2013.01); *D21H 27/005* (2013.01)

(58) Field of Classification Search
CPC .... B32B 23/04; D21H 27/007; D21H 27/005; D21H 11/04; Y10T 428/1303; Y10T 428/31986; Y10T 428/31971
USPC ..... 428/536
See application file for complete search history.

(56) References Cited

U.S. PATENT DOCUMENTS 5,048,589 A 9/1991 Cook et al.
5,383,778 A 1/1995 Schulz
5,399,412 A 3/1995 Sudall et al.
5,443,691 A 8/1995 Phan et al.
5,490,902 A 2/1996 Schulz
5,607,555 A 3/1997 Grossmann et al.
5,672,248 A 9/1997 Wendt et al.
5,882,743 A 3/1999 McConnell
5,908,533 A 6/1999 Marinack et al.
6,162,327 A 12/2000 Batra et al.
6,171,442 B1 1/2001 Farrington, Jr. et al.
6,727,004 B2 4/2004 Goulet et al.
6,855,228 B1 2/2005 Perini
6,918,993 B2 7/2005 Tirimacco
6,998,016 B2 2/2006 Yeh et al.
7,160,418 B2 1/2007 Edwards et al.
7,449,085 B2 11/2008 Hermans et al.
RE40,724 E 6/2009 Barnholtz
7,799,169 B2 9/2010 Bhat et al.
7,828,932 B2 11/2010 Hermans et al.
7,867,361 B2 1/2011 Salaam et al.
7,972,475 B2 7/2011 Chan et al.
RE42,968 E 11/2011 Sheehan et al.
8,070,913 B2 12/2011 Salaam et al.
8,110,072 B2 2/2012 Ampulski
8,187,419 B2 5/2012 Chan et al.
8,202,605 B2 6/2012 Ostendorf et al.
8,273,446 B2 9/2012 Conner et al.
8,481,133 B2 7/2013 Hermans et al.
8,652,597 B2 2/2014 Hermans et al.
8,753,751 B1 * 6/2014 Hermans ..... D21H 11/04 428/34.2
9,234,313 B2 * 1/2016 Hermans ..... D21H 11/04
9,447,545 B2 * 9/2016 Hermans ..... D21H 11/04 428/34.2
2004/0118532 A1 6/2004 Sarbo et al.
2004/0140076 A1 7/2004 Hermans et al.
2005/0045293 A1 3/2005 Hermans et al.
2005/0274470 A1 12/2005 Shannon et al.
2007/0102127 A1 5/2007 Hermans et al.
2007/0256802 A1 11/2007 Sheehan et al.
2008/0196849 A1 8/2008 Allen et al.
2009/0218056 A1 9/2009 Manifold et al.
2010/0051218 A1 3/2010 Allen et al.

FOREIGN PATENT DOCUMENTS

EP 1 583 869 B1 2/2008
EP 2 013 416 B1 1/2011

* cited by examiner

*Primary Examiner* — Leszek Kiliman
(74) *Attorney, Agent, or Firm* — Kimberly-Clark Worldwide, Inc.

(57) ABSTRACT

The present disclosure offers an improvement in papermaking methods and products, by providing a tissue sheet and a method to obtain a tissue sheet, with improved absorbency at a given basis weight. Thus, by way of example, the present disclosure provides a single ply tissue sheet having a basis weight greater than about 50 gsm and a specific vertical absorbent capacity greater than about 6.0 g/g.

8 Claims, 2 Drawing Sheets

ABSORBENT TISSUE

RELATED APPLICATIONS

The present application is a continuation application of, and claims priority to, U.S. patent application Ser. No. 14/962,676, filed on Dec. 8, 2015, which is a continuation application of U.S. patent application Ser. No. 14/271,545, filed on May 7, 2014, now U.S. Pat. No. 9,234,313, which is a continuation application of U.S. patent application Ser. No. 13/755,442, filed on Jan. 31, 2013, now U.S. Pat. No. 8,753,751, all of which are incorporated herein by reference.

BACKGROUND

In the development and manufacture of paper products, particularly paper towels for the consumer market, it is a continual objective to improve the absorbent characteristics of the product. For cleaning up some spills, the consumer needs high absorbent capacity. For some uses, consumers want a fast rate of absorbency. For other uses, a combination of high absorbent capacity and fast absorbent rate is desired. At the same time, constraints on achieving this objective include the need to maintain or reduce costs in order to provide the consumer with the highest possible value, which in part means minimizing the amount of fiber in the product.

SUMMARY

It has now been surprisingly discovered that absorbency may be increased, even at higher basis weights and tensile strengths, by manufacturing a tissue sheet using a process in which the embryonic web is subjected to a high degree of rush transfer. The term "rush transfer" generally refers to the process of subjecting the embryonic web to differing speeds as it is transferred from one fabric in the papermaking process to another. The present disclosure provides a process in which the embryonic web is subjected to a high degree of rush transfer when the web is transferred from the forming fabric to the transfer fabric, i.e., the "first position." The overall speed differential between the forming fabric and the transfer fabric may be, for example, from about 30 to about 70 percent, more preferably from about 50 to about 60 percent.

Accordingly, in certain embodiments the present disclosure offers an improvement in papermaking methods and products, by providing a tissue sheet and a method to obtain a tissue sheet, with improved absorbency at a given basis weight. Thus, by way of example, the present disclosure provides a tissue sheet having increased absorbency at a given basis weight such that the specific vertical absorbent (measured as g/g) is equal to or greater than:

$$-0.0288*BW+7.923$$

where BW is the bone dry basis weight in grams per square meter (gsm).

In other embodiments the present disclosure provides a single ply tissue sheet having a basis weight greater than about 50 gsm and a specific vertical absorbent capacity greater than about 6.0 g/g.

In still other embodiments the present disclosure provides a single ply through-air dried tissue sheet having a basis weight greater than about 50 gsm, such as from about 50 to about 70 gsm, and a specific vertical absorbent capacity greater than about 6.0 g/g.

In yet other embodiments the present disclosure provides a high strength absorbent tissue product having a basis weight greater than about 50 gsm, a specific vertical absorbent capacity greater than about 6.0 g/g and a geometric mean tensile (GMT) greater than about 1500 g/3", such as from about 1500 to about 3500 g/3".

DEFINITIONS

Figure 1:
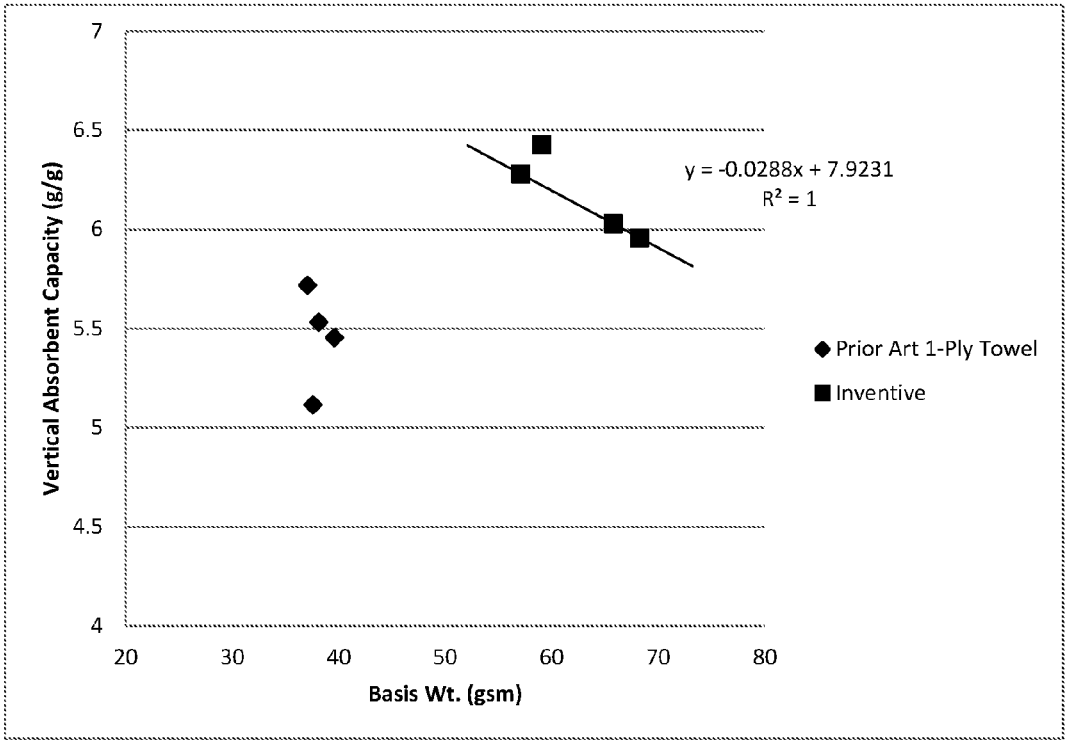
FIG. 1 is a graph plotting basis weight (x-axis) versus specific vertical absorbent capacity (y-axis) for prior art and inventive tissue products.

As used herein, the term "tissue product" refers to products made from tissue webs and includes, bath tissues, facial tissues, paper towels, industrial wipers, foodservice wipers, napkins, medical pads, and other similar products. Tissue products may comprise one, two, three or more plies.

As used herein, the terms "tissue web" and "tissue sheet" refer to a fibrous sheet material suitable for forming a tissue product.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "basis weight" generally refers to the bone dry weight per unit area of a tissue and is generally expressed as grams per square meter (gsm). Basis weight is measured using TAPPI test method T-220.

As used herein, the term "sheet bulk" refers to the quotient of the caliper (having units of microns) divided by the bone dry basis weight (having units of grams per square meter). Sheet bulk is expressed in cubic centimeters per gram (cc/g).

As used herein, the term "geometric mean tensile" (GMT) refers to the square root of the product of the machine direction tensile and the cross-machine direction tensile of the web, which are determined as described in the Test Method section.

As used herein, the term "specific vertical absorbent capacity" is a measure of the amount of water absorbed by the paper towel product, expressed as grams of water absorbed per gram of fiber (dry weight) in the product. Specific vertical absorbent capacity is measured as described in the Test Methods section and generally has units of grams per gram (g/g).

DETAILED DESCRIPTION

The instant tissue products and webs have a high degree of absorbent capacity at relatively high basis weights, such as greater than about 50 grams per square meter (gsm) and more preferably from about 50 to about 70 gsm and still more preferably from about 55 to about 65 gsm. The tissue products and webs also have relatively high bulk and tensile, such as sheet bulks greater than about 10 cc/g, such as from about 10 to about 12 cc/g and geometric mean tensile strengths (GMT) greater than about 1500 g/3", such as from about 1500 to about 3500 g/3" and still more preferably from about 1500 to about 2500 g/3". The combination of strong, bulky and absorbent sheets is achieved by subjecting the embryonic web to a speed differential as it is passed from one fabric in the papermaking process to another, commonly referred to as rush transfer. Rush transfer is preferably performed when the web is transferred from the forming fabric to the transfer fabric. Speed differentials between the forming fabric and the transfer fabric are generally from about 30 to about 70 percent and more preferably from about 50 to about 60 percent.

The increased absorbency at a given basis weight, particularly at basis weights greater than about 50 gsm, is surprising as basis weight typically negatively effects absorbency, i.e., as basis weight is increased, absorbency decreases. The present tissue webs and products however, have relatively high absorbencies, such as specific vertical absorbent capacities greater than about 6.0 g/g, such as from about 6.0 to about 7.0 g/g, at basis weights greater than about 50 gsm, such as from about 50 to about 70 gsm and more preferably from about 55 to about 65 gsm. In fact, it has now been discovered that by subjecting the embryonic web to high rates of rush transfer, absorbency may be increased across a wide range of basis weights and the negative effect of basis weight on absorbency may be minimized.

With reference to FIG. 1, which plots basis weight (x-axis) versus specific vertical absorbent capacity (y-axis) for prior art and inventive tissue products, the absorbent capacity of inventive tissue products is consistently greater than the absorbent capacity of prior art products. Accordingly, in a particularly preferred embodiment the present invention provides a tissue product wherein the specific vertical capacity (measured in g/g) is linearly related to the bone dry basis weight of the tissue product (measured in grams per square meter) by Equation 1, below:

$$\text{Vertical Absorbent Capacity (g/g)} \geq 0.0288BW+7.923 \quad \text{(Equation 1)}$$

where BW is the bone dry basis weight in grams per square meter (gsm).

In a particularly preferred embodiment the present disclosure provides single ply tissue products and more preferably through-air dried single ply tissue products, having a bone dry basis weight from about 50 to about 70 gsm, a GMT greater than about 1500 g/3" and a specific vertical absorbent capacity equal to or greater than −0.0288BW+7.923, where BW is the bone dry basis weight in grams per square meter (gsm). The improvement in absorbent capacity at relatively high basis weights is further illustrated in Table 1, below.

TABLE 1

| Product | Plies | Vertical Absorbent Capacity (g) | Specific Vertical Absorbent Capacity (g/g) | Basis Weight (gsm) | Caliper (μm) | Sheet Bulk (cc/g) |
|---|---|---|---|---|---|---|
| Bounty Basic | 1 | 2.4 | 5.5 | 38.1 | 683.3 | 17.9 |
| Scott Naturals | 1 | 2.4 | 5.5 | 39.6 | 769.6 | 19.4 |
| Scott Towels | 1 | 2.4 | 5.7 | 37.1 | 650.2 | 17.5 |
| 692A | 1 | 4.2 | 6.4 | 59.1 | 774.7 | 13.1 |
| 692B | 1 | 4.0 | 6.3 | 57.1 | 677.2 | 11.9 |

While having improved properties, the tissue webs prepared according to the present disclosure continue to be strong enough to withstand use by a consumer. For example, tissue webs prepared according to the present disclosure may have a geometric mean tensile (GMT) greater than about 1500 g/3", such as from about 1500 to about 3500 g/3", and more preferably from about 2000 to about 2500 g/3". When the tissue webs of the present disclosure are converted into rolled tissue products, they maintain a significant amount of their tensile strength, such that the decrease in geometric mean tensile during conversion of the web to finished product is less than about 30 percent and still more preferably less than about 25 percent, such as from about 10 to about 30 percent. As such the finished products preferably have a GMT strength of greater than 1500 g/3", such as from about 1750 to about 3000 g/3", and more preferably from about 2500 to about 2750 g/3".

Not only are the tissue webs of the present disclosure strong enough to withstand use, but they are also highly absorbent. For example, the tissue products preferably have a GMT greater than about 1500 g/3", such as from about 1500 to about 3000 g/3" and more preferably from about 2000 to about 2500 g/3" and a specific vertical absorbent capacity greater than about 6.0 g/g, such as from about 6.0 to about 7.0 g/g.

In addition to having relatively high absorbency at a given basis weight and GMT the tissue webs and products of the present invention have improved caliper and bulk as illustrated in Table 2, below. Accordingly, it has now been discovered that tissue products having a GMT from about 2000 to about 3000 g/3" and a basis weight from about 50 to about 65 gsm may be produced such that the product has a sheet bulk of greater than 10 cc/g, such as from about 10 to about 12 cc/g.

Figure 2:
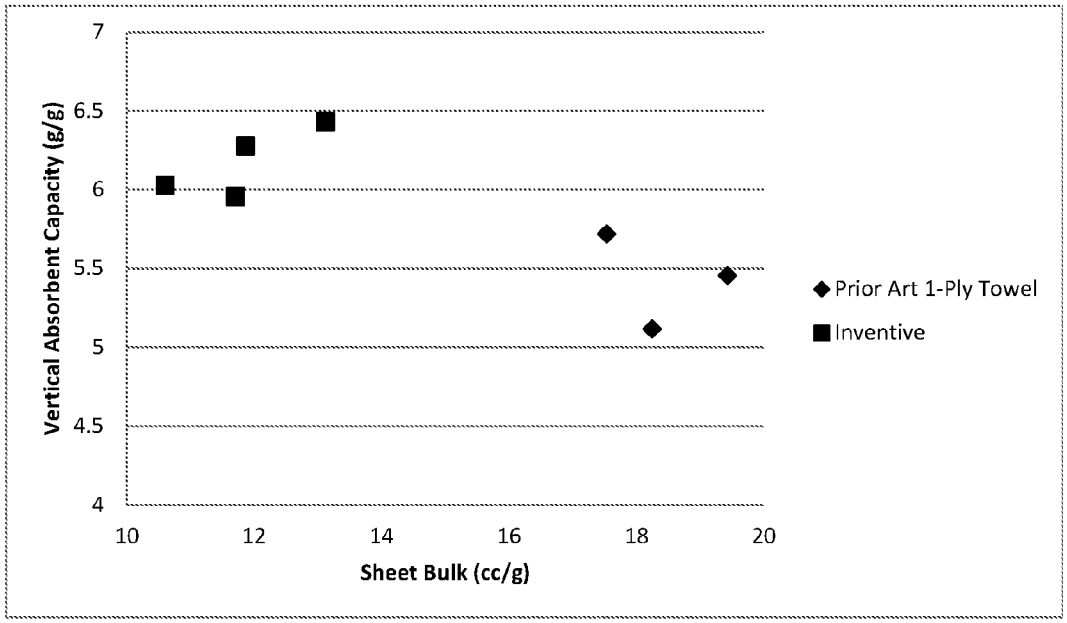
FIG. 2 is a graph plotting sheet bulk (x-axis) versus specific vertical absorbent capacity (y-axis) for prior art and inventive tissue products.
Figure 3:
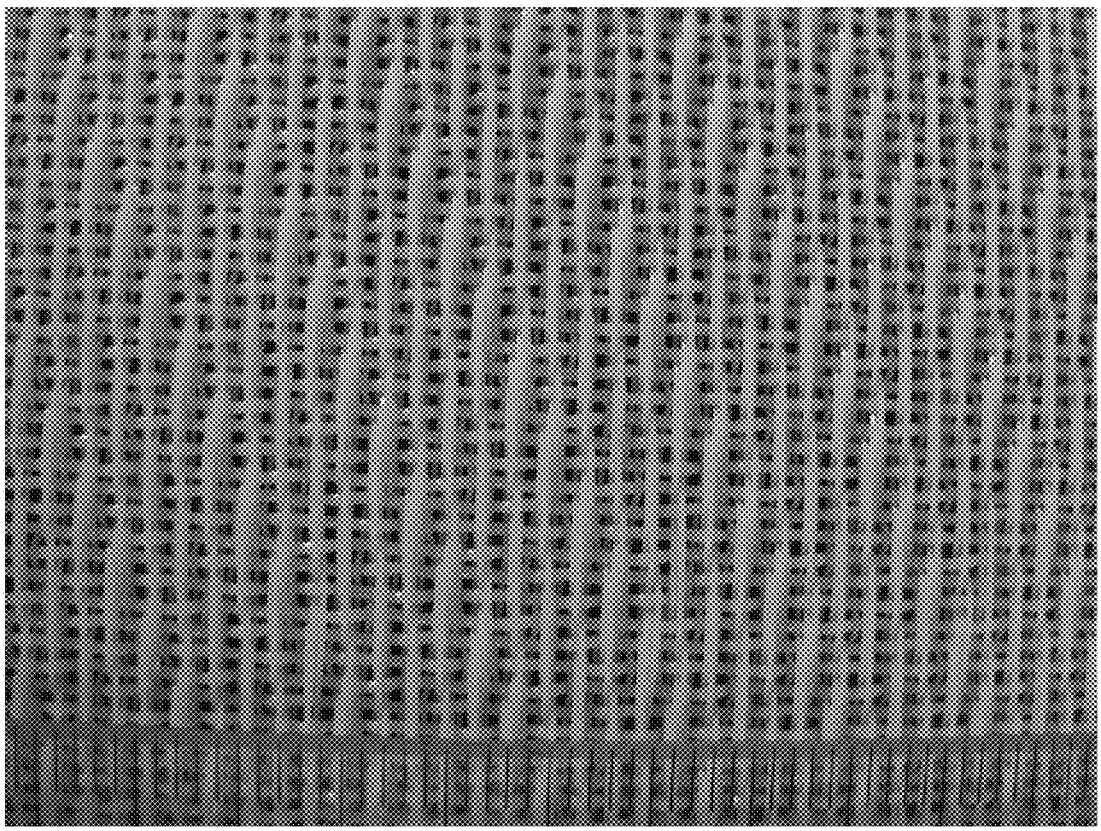
FIG. 3 is a photograph of a through-air drying fabric, designated as t2407-13, useful in producing the inventive tissue disclosed herein.

The improvement in absorbency at a given bulk is further illustrated in FIG. 2, which plots sheet bulk (x-axis) versus specific vertical absorbent capacity (y-axis) for prior art and inventive tissue products. In a particularly preferred embodiment the present disclosure provides a single ply having a sheet bulk from about 10 to about 12 cc/g, a GMT from about 2000 to about 2500 g/3" and a vertical absorbent capacity greater than about 6.0 g/g.

Webs useful in preparing tissue products according to the present disclosure can vary depending upon the particular application. In general, the webs can be made from any suitable type of fiber. For instance, the base web can be made from pulp fibers, other natural fibers, synthetic fibers, and the like. Suitable cellulosic fibers for use in connection with this invention include secondary (recycled) papermaking fibers and virgin papermaking fibers in all proportions. Such fibers include, without limitation, hardwood and softwood fibers as well as nonwoody fibers. Noncellulosic synthetic fibers can also be included as a portion of the furnish.

Tissue webs made in accordance with the present disclosure can be made with a homogeneous fiber furnish or can be formed from a stratified fiber furnish producing layers within the single- or multi-ply product. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present disclosure includes a first outer layer and a second outer layer containing primarily hardwood fibers. The hardwood fibers can be mixed, if desired, with paper broke in an amount up to about 10 percent by weight and/or softwood fibers in an amount up to about 10 percent by weight. The base web further includes a middle layer positioned in between the first outer layer and the second outer layer. The middle layer can contain primarily softwood fibers. If desired, other fibers, such as high-yield fibers or synthetic fibers may be mixed with the softwood fibers in an amount up to about 10 percent by weight.

When constructing a web from a stratified fiber furnish, the relative weight of each layer can vary depending upon the particular application. For example, in one embodiment, when constructing a web containing three layers, each layer can be from about 15 to about 40 percent of the total weight of the web, such as from about 25 to about 35 percent of the weight of the web.

Wet strength resins may be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene™), Henkel Corp. (Fibrabone™), Borden Chemical (Cascamide™), Georgia-Pacific Corp. and others. These polymers are characterized by having a polyamide backbone containing reactive crosslinking groups distributed along the backbone. Other useful wet strength agents are marketed by American Cyanamid under the Parez™ trade name.

Similarly, dry strength resins can be added to the furnish as desired to increase the dry strength of the final product. Such dry strength resins include, but are not limited to carboxymethyl celluloses (CMC), any type of starch, starch derivatives, gums, polyacrylamide resins, and others as are well known. Commercial suppliers of such resins are the same as those that supply the wet strength resins discussed above.

Another strength chemical that can be added to the furnish is Baystrength 3000 available from Kemira (Atlanta, Ga.), which is a glyoxalated cationic polyacrylamide used for imparting dry and temporary wet tensile strength to tissue webs.

As described above, the tissue products of the present disclosure can generally be formed by any of a variety of papermaking processes known in the art. Preferably the tissue web is formed by through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multiply tissue products, the separate plies can be made from the same process or from different processes as desired.

Preferably the base web is formed by an uncreped through-air drying process, such as the process described, for example, in U.S. Pat. Nos. 5,656,132 and 6,017,417, both of which are hereby incorporated by reference herein in a manner consistent with the present disclosure.

In one embodiment the web is formed using a twin wire former having a papermaking headbox that injects or deposits a furnish of an aqueous suspension of papermaking fibers onto a plurality of forming fabrics, such as the outer forming fabric and the inner forming fabric, thereby forming a wet tissue web. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of greater than 20 percent, more specifically between about 20 to about 40 percent, and more specifically between about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.).

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 30 to about 70 percent and more preferably from about 40 to about 60 percent. This is commonly referred to as "rush transfer". During rush transfer many of the bonds of the web are believed to be broken, thereby forcing the sheet to bend and fold into the depressions on the surface of the transfer fabric. Such molding to the contours of the surface of the transfer fabric may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web is then transferred from the transfer fabric to a through-air drying fabric. Typically, the transfer fabric travels at approximately the same speed as the through-air drying fabric. However, a second rush transfer may be performed as the web is transferred from the transfer fabric to the through-air drying fabric. This rush transfer is referred to as occurring at the second position and is achieved by operating the through-air drying fabric at a slower speed than the transfer fabric.

In addition to rush transferring the wet tissue web from the transfer fabric to the through-air drying fabric, the wet tissue web may be macroscopically rearranged to conform to the surface of the through-air drying fabric with the aid of a vacuum transfer roll or a vacuum transfer shoe. If desired, the through-air drying fabric can be run at a speed slower than the speed of the transfer fabric to further enhance MD stretch of the resulting absorbent tissue product. The transfer may be carried out with vacuum assistance to ensure conformation of the wet tissue web to the topography of the through-air drying fabric.

While supported by a through-air drying fabric, the wet tissue web is dried to a final consistency of about 94 percent or greater by a through-air dryer. The web then passes through the winding nip between the reel drum and the reel and is wound into a roll of tissue for subsequent converting.

The following examples are intended to illustrate particular embodiments of the present disclosure without limiting the scope of the appended claims.

Test Methods

Tensile

Samples for tensile strength testing are prepared by cutting a 3" (76.2 mm)×5" (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 4±0.04 inches (50.8±1 mm). The jaws are operated using pneumatic-action and are rubber coated. The minimum grip face width is 3" (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

In addition to tensile strength, the stretch, tensile energy absorbed (TEA), and slope are also reported by the MTS TestWorks™ program for each sample measured. Stretch (either MD stretch or CD stretch) is reported as a percentage and is defined as the ratio of the slack-corrected elongation of a specimen at the point it generates its peak load divided by the slack-corrected gauge length. Slope is reported in the units of grams per unit width (typically grams per three inches) and is defined as the gradient of the least-squares line fitted to the load-corrected strain points falling between a specimen-generated force of 70 to 157 grams (0.687 to 1.540 N) divided by the specimen width.

Total energy absorbed (TEA) is calculated as the area under the stress-strain curve during the same tensile test as has previously been described above. The area is based on the strain value reached when the sheet is strained to rupture and the load placed on the sheet has dropped to 65 percent of the peak tensile load. For the TEA calculation, the stress is converted to grams per centimeter and the area calculated by integration. The units of strain are centimeters per centimeter so that the final TEA units become $g*cm/cm^2$.

Roll Firmness

Roll Firmness was measured using the Kershaw Test as described in detail in U.S. Pat. No. 6,077,590, which is incorporated herein by reference in a manner consistent with the present disclosure. The apparatus is available from Kershaw Instrumentation, Inc. (Swedesboro, N.J.) and is known as a Model RDT-2002 Roll Density Tester.

Absorbency

As used herein, "vertical absorbent capacity" is a measure of the amount of water absorbed by a paper product (single ply or multi-ply) or a sheet, expressed as grams of water absorbed per gram of fiber (dry weight). In particular, the vertical absorbent capacity is determined by cutting a sheet of the product to be tested (which may contain one or more plies) into a square measuring 100 millimeters by 100 millimeters (±1 mm.) The resulting test specimen is weighed to the nearest 0.01 gram and the value is recorded as the "dry weight." The specimen is attached to a 3-point clamping device and hung from one corner in a 3-point clamping device such that the opposite corner is lower than the rest of the specimen, then the sample and the clamp are placed into a dish of water and soaked in the water for 3 minutes (±5 seconds). The water should be distilled or de-ionized water at a temperature of 23±3° C. At the end of the soaking time, the specimen and the clamp are removed from the water. The clamping device should be such that the clamp area and pressure have minimal effect on the test result. Specifically, the clamp area should be only large enough to hold the sample and the pressure should also just be sufficient for holding the sample, while minimizing the amount of water removed from the sample during clamping. The sample specimen is allowed to drain for 3 minutes (±5 seconds). At the end of the draining time, the specimen is removed by holding a weighing dish under the specimen and releasing it from the clamping device. The wet specimen is then weighed to the nearest 0.01 gram and the value recorded as the "wet weight". The vertical absorbent capacity in grams per gram=[(wet weight−dry weight)/dry weight]. At least five (5) replicate measurements are made on representative samples from the same, roll or box of product to yield an average vertical absorbent capacity value.

EXAMPLES

Base sheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Base sheets with a target bone dry basis weight of about 60 grams per square meter (gsm) were produced. The base sheets were then converted and spirally wound into rolled tissue products.

In all cases the base sheets were produced from a furnish comprising northern softwood kraft and eucalyptus kraft using a layered headbox fed by three stock chests such that the webs having three layers (two outer layers and a middle layer) were formed. The layer splits, by weight of the web, are detailed in Table 2, below. Strength was controlled via the addition of CMC, Kymene and/or by refining the NSWK furnish of both the outer and center layers as set forth in Table 2, below.

The tissue web was formed on a Voith Fabrics TissueForm V forming fabric, vacuum dewatered to approximately 25 percent consistency and then subjected to rush transfer when transferred to the transfer fabric. The layer splits, by weight of the web, are detailed in Table 2, below. Strength was controlled via the addition of CMC, Kymene and/or by refining the NSWK furnish of the center layer as set forth in Table 2, below. The transfer fabric was the fabric described as t1207-11 (commercially available from Voith Fabrics, Appleton, Wis.).

The web was then transferred to a through-air drying fabric. The through-air drying fabric varied by sample, as set forth in Table 2, below. Transfer to the through-drying fabric was done using vacuum levels of greater than 10 inches of mercury at the transfer. The web was then dried to approximately 98 percent solids before winding.

Table 2 shows the process conditions for each of the samples prepared in accordance with the present example.

TABLE 2

| Sample | Layer Split (Wt. % Air/Middle/Felt) | Refining (hpt/day) | TAD Fabric | Rush Transfer (%) |
|---|---|---|---|---|
| 1 | 30 EUC/40 NSWK/30 EUC | In loop | T2407-13 | 60 |
| 2 | 30 EUC/40 NSWK/30 EUC | In loop | T2407-13 | 60 |
| 3 | 30 EUC/40 NSWK/30 EUC | 0 | T2407-13 | 40 |
| 4 | 30 EUC/40 NSWK/30 EUC | 0 | T2407-13 | 40 |

The base sheet webs were converted into various rolled towels. Specifically, base sheet was calendered using a conventional polyurethane/steel calender comprising a 4 P&J polyurethane roll on the air side of the sheet and a standard steel roll on the fabric side. Process conditions for each sample are provided in Table 3, below. All rolled products comprised a single ply of base sheet, such that rolled product sample Roll 1 comprised a single ply of base sheet sample 1, and so forth.

TABLE 3

| Sample | 4 P&J Calender Load (pli) | Product Basis Weight (gsm) | Product Sheet Caliper (μm) | Product Sheet Bulk (cc/g) | Roll Firmness (mm) |
|---|---|---|---|---|---|
| Roll 1 | 30 | 68.3 | 799.1 | 11.71 | 6.7 |
| Roll 2 | 80 | 65.8 | 697.9 | 10.61 | 5.6 |
| Roll 3 | 80 | 57.1 | 677.2 | 11.86 | 8.7 |
| Roll 4 | 30 | 59.1 | 774.7 | 13.12 | 8.7 |

TABLE 4

| Sample | Product GMT (g/3") | Product MD Stretch (%) | Product MD Slope (kg) | Product GM Slope (kg) | Product MD TEA (g * cm/cm$^2$) | Product Stiffness Index |
|---|---|---|---|---|---|---|
| Roll 1 | 2269 | 60.0 | 4.5 | 8.50 | 86.6 | 3.75 |
| Roll 2 | 2016 | 53.0 | 5.9 | 9.26 | 68.7 | 4.6 |
| Roll 3 | 1697 | 29.2 | 5.1 | 6.91 | 37.3 | 4.1 |
| Roll 4 | 1850 | 34.2 | 5.2 | 7.31 | 47.6 | 3.95 |

TABLE 5

| Sample | Product Specific Vertical Absorbent Capacity (g/g) | Product Vertical Absorbent Capacity (g) |
|---|---|---|
| Roll 1 | 6.0 | 4.5 |
| Roll 2 | 6.0 | 4.4 |
| Roll 3 | 6.3 | 4.0 |
| Roll 4 | 6.4 | 4.2 |

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

We claim:

1. A single-ply wet-laid tissue product having a MD Stretch greater than about 30 percent, a sheet bulk from about 10 to about 12 cc/g, geometric mean tensile (GMT) from about 2,200 to about 3,500 g/3", a bone dry basis weight from about 60 to about 70 square meter (gsm) and a specific vertical absorbent capacity from about 6.0 to about 7.0 g/g.

2. The tissue product of claim 1 having a GM Slope from about 6.0 to about 8.0 kg.

3. The tissue product of claim 1 having a Stiffness Index less than about 5.0.

4. The tissue product of claim 1 having a MD Stretch greater than about 30 percent.

5. The tissue product of claim 1 wherein the GMT is from about 2,500 to about 3,000 g/3".

6. The tissue product of claim 1 spirally wound into a roll, the roll having a Roll Firmness from about 6.0 to about 8.0 mm.

7. The tissue product of claim 1 wherein the tissue product is through-air dried.

8. The tissue product of claim 1 wherein the tissue product is uncreped.

* * * * *